US011518055B2

(12) United States Patent
Chang

(10) Patent No.: US 11,518,055 B2
(45) Date of Patent: Dec. 6, 2022

(54) RAZOR HANDLE AND RAZOR ASSEMBLY USING THE SAME

(71) Applicant: DORCO CO., LTD., Seoul (KR)

(72) Inventor: Jun Soo Chang, Seoul (KR)

(73) Assignee: DORCO CO., LTD., Seoul (KR)

( * ) Notice: Subject to any disclaimer, the term of this patent is extended or adjusted under 35 U.S.C. 154(b) by 36 days.

(21) Appl. No.: 16/921,786

(22) Filed: Jul. 6, 2020

(65) Prior Publication Data

US 2021/0008744 A1 Jan. 14, 2021

(30) Foreign Application Priority Data

Jul. 10, 2019 (KR) ..... 10-2019-0083193

(51) Int. Cl.
*B26B 21/52* (2006.01)
*B26B 21/22* (2006.01)
*B26B 21/40* (2006.01)

(52) U.S. Cl.
CPC ..... *B26B 21/521* (2013.01); *B26B 21/225* (2013.01); *B26B 21/4018* (2013.01); *B26B 21/4025* (2013.01); *B26B 21/4031* (2013.01)

(58) Field of Classification Search
None
See application file for complete search history.

(56) References Cited

U.S. PATENT DOCUMENTS 831,259 A * 9/1906 Bingler ..... B26B 21/521 30/531
5,687,485 A 11/1997 Shurtleff et al.
5,761,814 A 6/1998 Anderson et al.
5,956,848 A 9/1999 Tseng et al.
5,956,851 A 9/1999 Apprille et al.
6,041,926 A 3/2000 Petricca et al.
6,052,903 A 4/2000 Metcalf et al.
(Continued)

FOREIGN PATENT DOCUMENTS

EP 3 763 496 A1 * 1/2021
JP 1990052694 2/1990
(Continued)

OTHER PUBLICATIONS

European Patent Office Application Serial No. 20184695.3, Search Report dated Nov. 16, 2020, 8 pages.

*Primary Examiner* — Hwei-Siu C Payer
(74) *Attorney, Agent, or Firm* — Lee, Hong, Degerman, Kang & Waimey PC

(57) ABSTRACT

A razor handle includes a handle body including a head adapter and a grip portion extending from the head adapter; a connecting head configured to be coupled to a razor cartridge and coupled to the head adapter head so as to be pivotable around a rotational axis, the connecting head including a head side cam surface on one side thereof; and a plunger disposed on one side of the handle body and including a plunger side cam surface configured to perform a cam action with the head side cam surface, the plunger being configured to provide, through the cam action, recovery force to restore the connecting head to a rest position, wherein a contact area between the head side cam surface and the plunger side cam surface is smaller when the connecting head is deviated from the rest position than when the connecting head is in the rest position.

12 Claims, 13 Drawing Sheets

(56) References Cited

U.S. PATENT DOCUMENTS

| | | | | |
|---|---|---|---|---|
| 6,185,822 | B1 | 2/2001 | Tseng et al. | |
| 6,212,777 | B1 | 4/2001 | Gilder et al. | |
| 6,442,839 | B1 | 9/2002 | Tseng et al. | |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 8,205,343 | B2 * | 6/2012 | Winter | B26B 21/40 30/527 |
| 8,205,344 | B2 * | 6/2012 | Stevens | B26B 21/521 30/527 |
| 9,073,226 | B2 | 7/2015 | Szczepanowski et al. | |
| 9,327,414 | B2 | 5/2016 | Szczepanowski et al. | |
| 10,843,357 | B2 * | 11/2020 | Jang | B26B 21/4012 |
| 10,974,403 | B2 * | 4/2021 | Chang | B26B 21/225 |
| 11,034,038 | B2 * | 6/2021 | Chang | B26B 21/14 |
| 2017/0173806 | A1 | 6/2017 | Lee | |
| 2019/0152077 | A1 * | 5/2019 | Kim | B26B 21/225 |
| 2021/0008744 | A1 * | 1/2021 | Chang | B26B 21/521 |

FOREIGN PATENT DOCUMENTS

| | | |
|---|---|---|
| JP | 1992022388 | 1/1992 |
| JP | 3730802 | 10/2005 |
| WO | 0200401 | 1/2002 |

* cited by examiner

RAZOR HANDLE AND RAZOR ASSEMBLY USING THE SAME

CROSS-REFERENCE TO RELATED APPLICATION

Pursuant to 35 U.S.C. § 119(a), this application claims the benefit of earlier filing date and right of priority to Korean Patent Application No. 10-2019-0083193, filed on Jul. 10, 2019, the contents of which are hereby incorporated by reference herein in its entirety.

BACKGROUND OF THE INVENTION

1. Field of the Invention

The present disclosure relates to a razor handle and a razor assembly using the same.

2. Description of the Related Art

The statements in this section merely provide background information related to the present disclosure and may not constitute prior art.

A conventional razor assembly, commonly known as a wet razor, includes a razor cartridge and a razor handle.

The razor cartridge is configured to be rotatable around the razor handle between a rest position and a pivoting position, which is deviated from the rest position. Pivoting motion of the razor cartridge is basically made about a rotational axis (hereinafter, a "parallel axis") parallel to an alignment direction of a shaving blade.

The pivoting motion of the razor cartridge about the parallel axis helps the shaving blade to smoothly contact a user's skin, thereby enabling efficient shaving.

Recently, a multi-axial pivoting razor that provides a function of pivoting on a rotational axis (hereinafter, a "vertical axis") perpendicular to the parallel axis as well as the function of pivoting about the parallel axis has been introduced.

The multi-axial pivoting razor enables the razor cartridge to pivot on two or more axes, thereby allowing the shaving blade to more smoothly contact the user's skin along the profile of the user's skin.

Japanese Patent Publication No. 2-52694 (hereinafter, Patent Document 1) discloses a conventional multi-axial pivoting shaver including a plunger having a spring inside to implement a function of pivoting on a vertical axis (hereinafter, a "vertical pivoting function").

Specifically, Patent Document 1 discloses that a vertical pivoting function is provided using a cam action between a cam surface formed at one end of the plunger and a cam surface formed on the razor cartridge.

However, according to Patent Document 1, in a rest position, the cam surface of the plunger and the cam surface of the razor cartridge are configured to make a point contact at a single point. As a result, the razor cartridge does not remain fixed at a position, but dangles.

Accordingly, stable shaving may not be supported for the user.

To address this issue, Japanese Patent Publication No. 3,730,802 (hereinafter, Patent Document 2) discloses another conventional multi-axial pivoting razor including a plunger having a concave cam surface and a razor cartridge having a convex cam surface with a greater curvature than the concave cam surface of the plunger.

Specifically, Patent Document 2 discloses that, in a rest position, the cam surface of the plunger and the cam surface of the razor cartridge are arranged to contact each other at two symmetrical points to have rotational resistance against initial rotation.

However, Patent Document 2 discloses that the cam surface of the plunger and the cam surface of the razor cartridge are configured to contact each other at two points even when they deviate from the rest position.

Accordingly, in Patent Document 2, in a position deviated from the rest position, moments are generated at the respective contact points in opposite directions of rotation. Thus, part of the elastic force by the spring of the plunger may be used to generate moment in the direction opposite to the direction of the recovery force.

Accordingly, the plunger of Patent Document 2 may fail to effectively provide recovery force to the razor cartridge. As a result, an appropriate vertical pivoting function may not be provided to the multi-axial pivoting razor.

SUMMARY OF THE INVENTION

Therefore, the present disclosure has been made in view of the above problems, and it is an object of the present disclosure to provide a razor handle and a razor assembly which are capable of providing stable shaving in a rest position by providing rotational resistance to the razor cartridge, and effectively providing recovery force to the razor cartridge by concentrate the moment in one rotational direction when the position is deviated from the rest position.

In accordance with the present invention, the above and other objects can be accomplished by the provision of a razor handle including: a handle body including a head adapter and a grip portion extending from the head adapter; a connecting head configured to be coupled to a razor cartridge and coupled to the head adapter head so as to be pivotable around a rotational axis, the connecting head including a head side cam surface on one side thereof; and a plunger disposed on one side of the handle body and including a plunger side cam surface configured to perform a cam action with the head side cam surface, the plunger being configured to provide, through the cam action, recovery force to restore the connecting head to a rest position, wherein a contact area between the head side cam surface and the plunger side cam surface is smaller when the connecting head is deviated from the rest position than when the connecting head is in the rest position.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
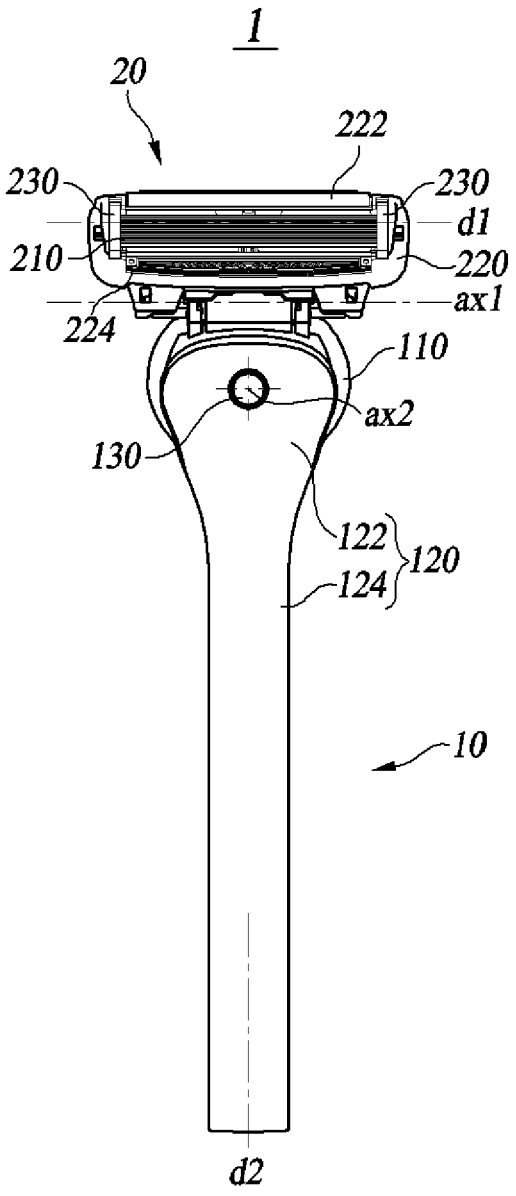
FIG. 1 is a front view of a razor assembly according to an embodiment of the present disclosure.

Hereinafter, some embodiments of the present disclosure will be described in detail with reference to exemplary drawings. It should be noted that in assigning reference numerals to components in each drawing, the same reference numbers will be used throughout the drawings to refer to the same or like components even though the components are shown in different drawings. In addition, in describing the present disclosure, detailed descriptions of related known elements or functions will be omitted to avoid obscuring the subject matter of the present disclosure.

In describing the components of embodiments according to the present disclosure, terms including ordinal numbers such as first, second, i), ii), a), and b) may be used. These terms are merely used to distinguish one component from another, and the essence or order of the components is not limited by the terms. In the specification, when it is stated that a part "includes" or "has" a component, this means that the part may further include other components, rather than excluding other components, unless explicitly stated otherwise.

Figure 2:
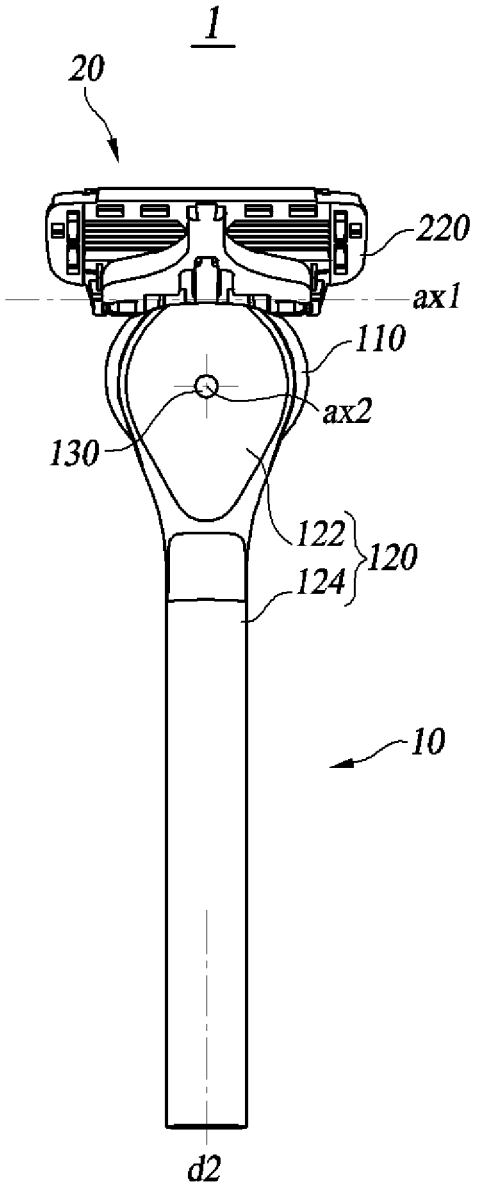
FIG. 2 is a rear view of a razor assembly according to an embodiment of the present disclosure.

FIG. 1 is a front view of a razor assembly 1 and FIG. 2 is a rear view of the razor assembly 1 according to an embodiment of the present disclosure. Referring to FIGS. 1 and 2, the razor assembly 1 may include a razor handle 10 and a razor cartridge 20.

The razor cartridge 20 may include a shaving blade 210, a blade housing 220, and a clip 230.

The blade housing 220 may accommodate at least one shaving blade 210 having a cutting edge.

Specifically, the at least one shaving blade 210 may be retained by a plurality of clips 230 while being accommodated at one side of the blade housing 220.

The blade housing 220 may include a cap 222 and a guard 224.

The cap 222 may be located behind the shaving blade 210. Specifically, the cap 222 may be disposed on a top surface of the blade housing 220 facing the cutting edge.

The guard 224 may be located in front of the shaving blade 210 on the top surface of the blade housing 220.

During shaving, the guard 224 may stretch the skin in a shaving direction before the body hair is cut by the shaving blade 210.

Thereby, the user's body hair may rise in a direction perpendicular to the user's skin surface, whereby the shaving blade 210 may more easily cut the body hair.

The clip 230 may retain the shaving blade 210 in the blade housing 220. Thereby, the shaving blade 210 may be prevented from being detached from the blade housing 220.

The razor handle 10 may include a connecting head 110 and a handle body 120.

The connecting head 110 may be configured to be connected to the razor cartridge 20.

Specifically, the razor cartridge 20 may be connected to the connecting head 110 so as to be pivotable about a pivot axis ax1 parallel to a transverse direction d1.

Figure 5:
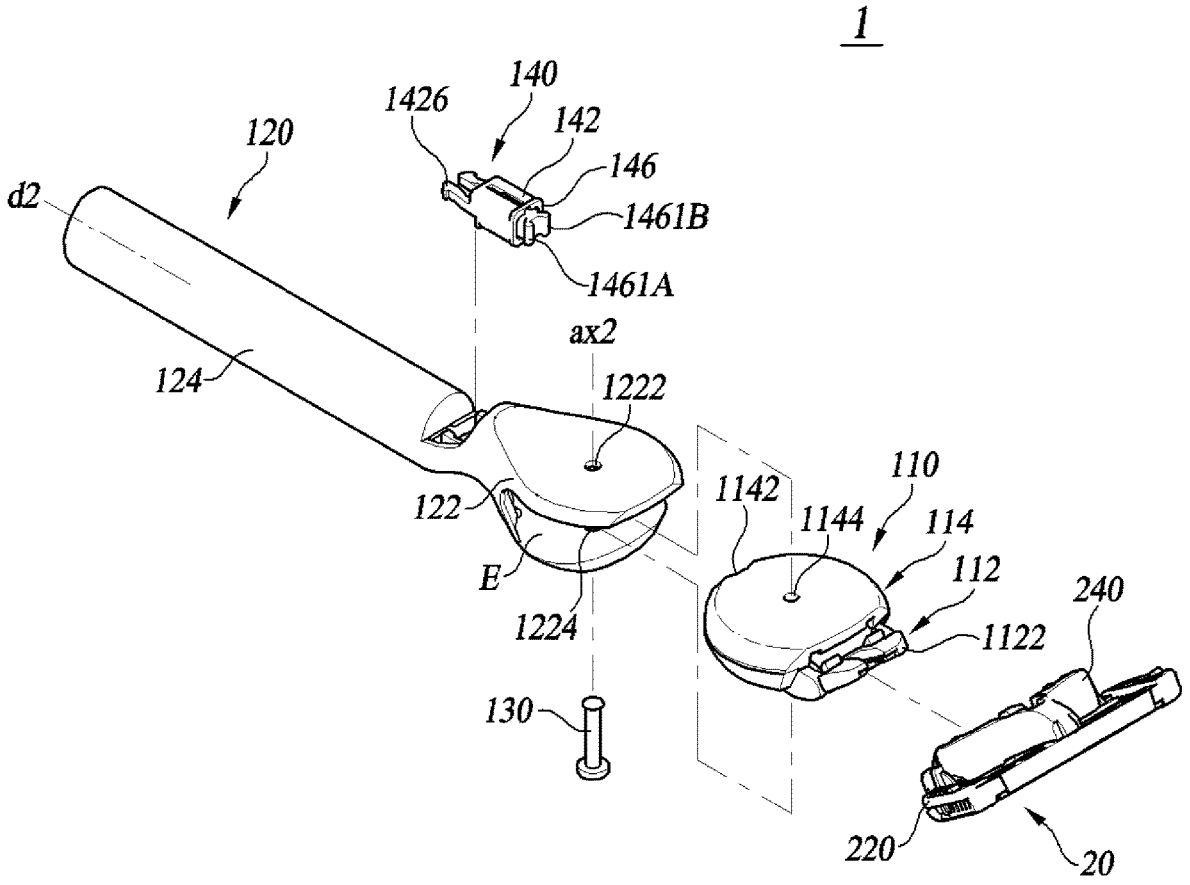
FIG. 5 is an exploded perspective view of a razor assembly according to an embodiment of the present disclosure.

Referring to FIG. 5, the connecting head 110 may include a head side cam surface 1142 on one side thereof. The head side cam surface 1142 may be provided with recovery force by performing a cam action with a plunger side cam surface 1461 of a plunger 140.

Referring back to FIGS. 1 and 2, the handle body 120 may include a head adapter 122 and a grip portion 124.

The connecting head 110 may be connected to the head adapter 122 so as to be pivotable around a rotational axis ax2.

The grip portion 124 may extend from the head adapter 122 and provide a gripping area to the user.

Figure 3:
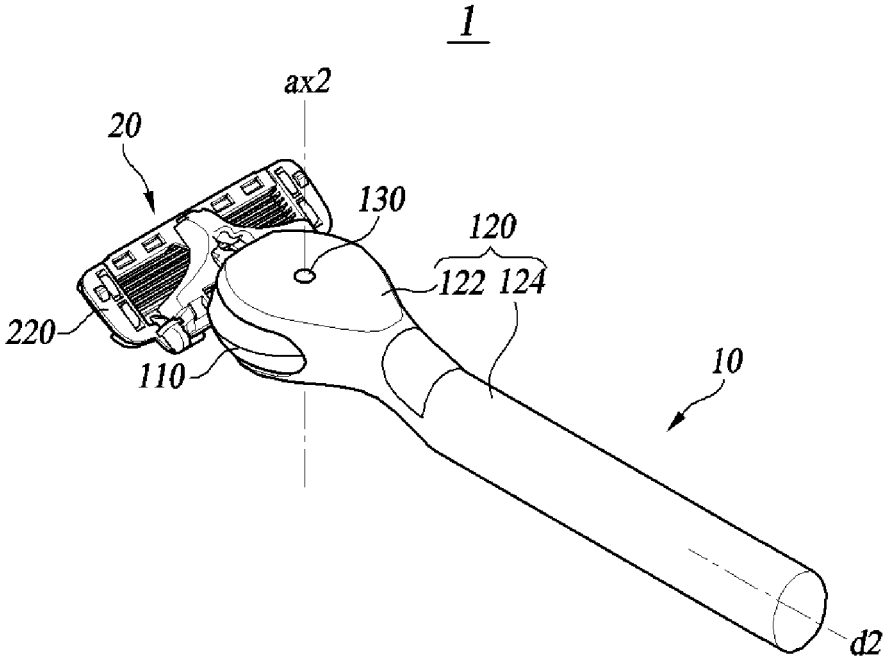
FIG. 3 is a rear perspective view of a razor assembly according to an embodiment of the present disclosure.

FIG. 3 is a rear perspective view of the razor assembly 1 according to an embodiment of the present disclosure.

Referring to FIG. 3, the connecting head 110 may be connected to the head adapter 122 so as to be pivotable around the rotational axis ax2.

Specifically, the connecting head 110 may be connected so as to be pivotable around the rotational axis ax2 with respect to the head adapter 122 in a receiving space E (see FIG. 5) formed in the head adapter 122.

The rotational axis ax2 may be substantially perpendicular to the transverse direction d1. However, the present disclosure is not limited thereto.

The longitudinal direction d2 may be a direction in which the grip portion 124 extends, and may be perpendicular to both the transverse direction d1 and the rotational axis ax2. However, the present disclosure is not limited thereto.

For example, the grip portion 124 may be curved at a certain angle for user convenience and extended from the head adapter 122. In this case, the longitudinal direction d2 may be perpendicular to the transverse direction d1, but not perpendicular to the rotational axis ax2.

Figure 4:
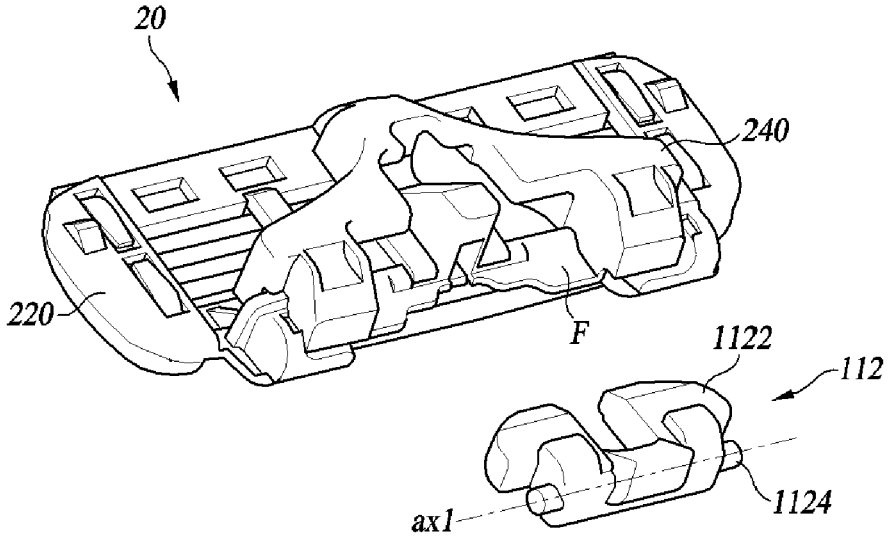
FIG. 4 is a rear perspective view of a razor cartridge and a head side connecting member according to an embodiment of the present disclosure.

FIG. 4 is a rear perspective view of a razor cartridge 20 and a head side connecting member 112 according to an embodiment of the present disclosure.

Referring to FIG. 4, the razor cartridge 20 may include a cartridge side connecting member 240, and the connecting head 110 may include a head side connecting member 112.

The cartridge side connecting member 240 may be disposed on a bottom surface of the razor cartridge 20 and be connected to the head side connecting member 112.

To this end, the cartridge side connecting member 240 may have a connecting space F capable of accommodating a locking protrusion 1122 of the head side connecting member 112.

The head side connecting member 112 may include the locking protrusion 1122 and a boss 1124.

The locking protrusion 1122 may be accommodated in the connecting space F formed in the cartridge side connecting member 240, and be connected to the razor cartridge 20 such that the relative positions of the locking protrusion 1122 and the razor cartridge 20 are fixed.

Specifically, the locking protrusion 1122 may be connected to the cartridge side connection part 240 in a manner of hook coupling.

Thereby, the connecting head 110 may be coupled to the razor cartridge 20.

The boss 1124 may be inserted into a boss hole (not shown) formed in the head body 114 (see FIG. 5) of the connecting head 110, thereby defining the pivot axis ax1.

The razor cartridge 20 connected to the head side connecting member 112 may pivot together with the head side connecting member 112 around the pivot axis ax1 with respect to the head body 114.

While it is illustrated in FIG. 4 that the cartridge side connecting member 240 is connected to the head side connecting member 112 such that the relative positions thereof are fixed, and that the head side connecting member 112 is pivotably connected to the head body 114, the present disclosure is not limited thereto.

For example, the cartridge side connecting member 240 may be pivotably connected to the head side connecting member 112. In this case, the head side connecting member 112 may be connected to the head body 114 such that the relative positions thereof are fixed.

FIG. 5 is an exploded perspective view of the razor assembly 1 according to an embodiment of the present disclosure.

Figure 6:
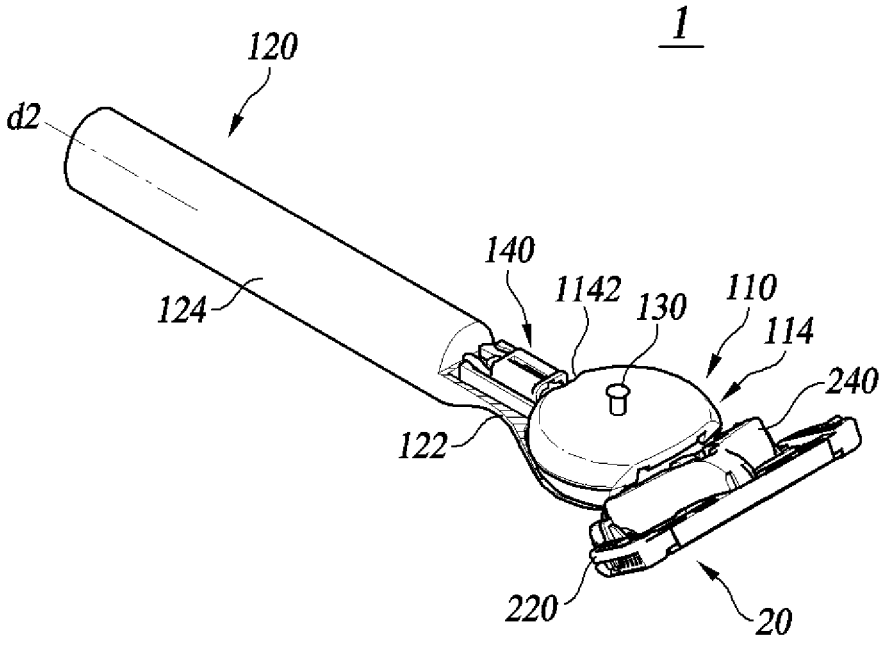
FIG. 6 is a perspective view of a razor assembly according to an embodiment of the present disclosure, with a part of a handle body removed in a longitudinal direction.

FIG. 6 is a perspective view of the razor assembly 1 according to an embodiment of the present disclosure, with a part of the handle body 120 removed in the longitudinal direction d2.

Referring to FIGS. 5 and 6, the razor assembly 1 may include a fastening member 130 and a plunger 140.

When the connecting head 110 remains accommodated in the receiving space E of the head adapter 122, the fastening member 130 may be arranged through a top through hole 1222 and a bottom through hole 1224, which are formed in the head adapter 122, and a rotation through hole 1144 formed in the head body 114. Thus, the fastening member 130 may define the rotational axis ax2.

The connecting head 110 may pivot around the rotational axis ax2, which is defined by the fastening member 130, with respect to the head adapter 122.

The plunger 140 may be disposed on one side of the handle body 120 to face the head side cam surface 1142 of the connecting head 110.

The plunger 140 may include a plunger side cam surface 1461 configured to perform a cam action with the head side cam surface 1142 of the connecting head 110.

Specifically, the head side cam surface 1142 may be formed on one surface of the head body 114 facing the plunger side cam surface 1461 of the plunger 140.

The plunger 140 may provide recovery force through the cam action between the plunger side cam surface 1461 and the head side cam surface 1142. The recovery force restores the connecting head 110 to a rest position.

Accordingly, when pivoted around the rotational axis ax2, away from the rest position, the connecting head 110 may be restored to the rest position through the recovery force provided from the plunger 140.

Figure 7A:
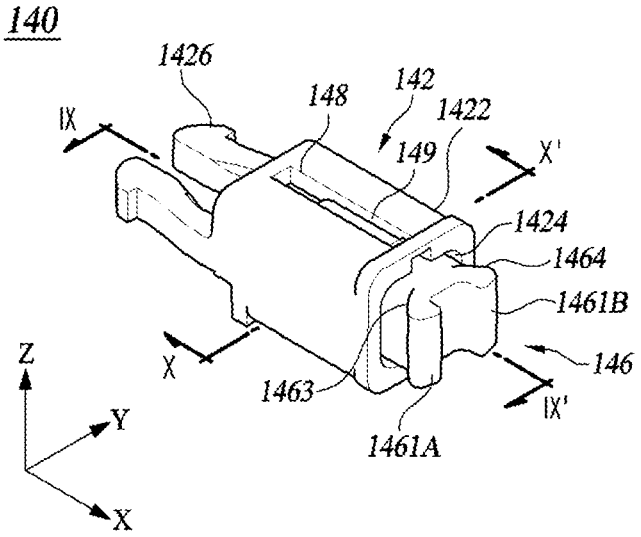
FIGS. 7A and 7B are front perspective views of a plunger according to an embodiment of the present disclosure.
Figure 7B:
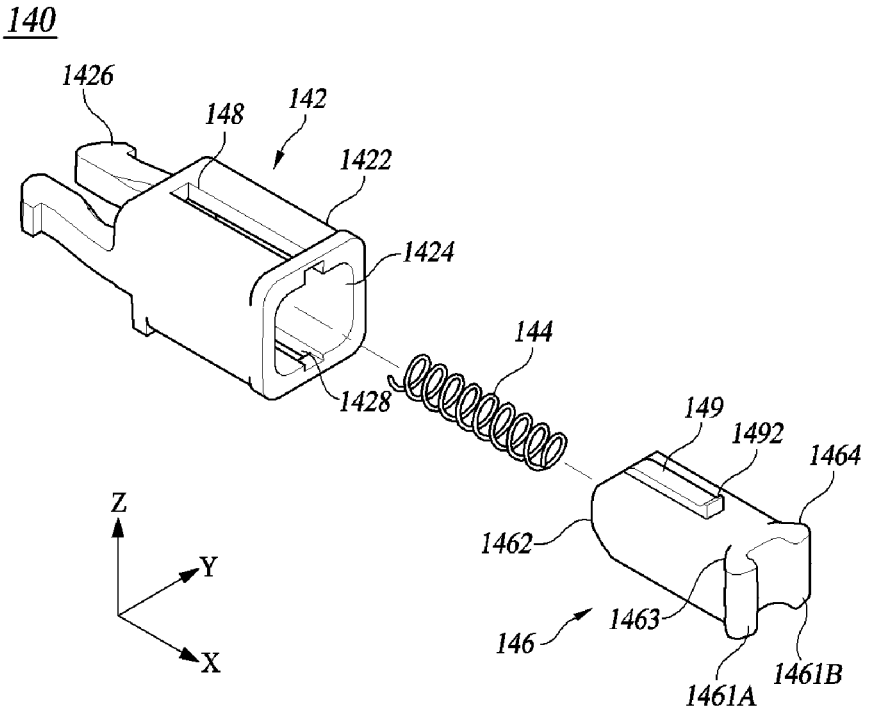

FIGS. 7A and 7B are front perspective views of the plunger 140 according to an embodiment of the present disclosure.

Specifically, FIG. 7A shows the plunger 140 in an assembled state, and FIG. 7B shows the plunger 140 in a disassembled state.

Referring to FIGS. 7A and 7B, the plunger 140 may include a plunger housing 142, an elastic member 144, and a cam action member 146.

The plunger housing 142 may include a housing body 1422, an action member receiving portion 1424, a fitting protrusion 1426, and a first guiding rail 148.

The action member receiving portion 1424 may be an opening formed on one surface of the housing body 1422.

The elastic member 144 and the cam action member 146 may be accommodated in the housing body 1422 through the action member receiving portion 1424.

In this case, at least a part of the cam action member 146 may be exposed to the outside of the housing body 1422 through the action member receiving portion 1424.

The cam action member 146 may perform a cam action with the head side cam surface 1142 of the connecting head 110 through the plunger side cam surface 1461 formed in the exposed portion.

The fitting protrusion 1426 may be snap-fitted or hook-coupled to a fitting jaw 1226 (see FIG. 11) formed on one side of the handle body 120. To this end, the fitting protrusion 1426 may be formed of an elastically deformable material.

As the fitting protrusion 1426 is coupled to the fitting jaw 1226, the plunger 140 may be mounted on the handle body 120.

While it is illustrated in FIGS. 5 and 6 that the plunger 140 and the handle body 120 are separate members, and the plunger 140 is connected to or mounted on one side of the handle body 120, the present disclosure is not limited thereto.

For example, the plunger housing 142 may be integrated with the handle body 120.

Referring back to FIGS. 7A and 7B, the first guiding rail 148 may be formed on one surface of the housing body 1422 to guide a first guided protrusion 149 formed on the cam action member 146.

The elastic member 144 may be formed of an elastic material, and be disposed inside the housing body 1422.

Specifically, the elastic member 144 may be penetrated by an extended protrusion 1429 (see FIGS. 9A and 9B) extending toward the action member receiving portion 1424 in the housing body 1422, and may thus be mounted in the housing body 1422.

One end of the elastic member 144 may be fixed to the housing body 1422, and the opposite end of the elastic member 144 may be fixed to the cam action member 146.

The elastic member 144 may be elastically deformed to press the cam action member 146 in a first direction. Thereby, the plunger side cam surface 1461 formed on the cam action member 146 may perform a cam action with the head side cam surface 1142.

In the present specification, the first direction refers to a direction in which the elastic member 144 presses the cam action member 146 through elastic deformation. For example, in FIGS. 7A and 7B, the first direction is the X-axis direction.

The extent to which the elastic member 144 is elastically deformed may be 0.1 mm to 3.0 mm, but the present disclosure is not limited thereto.

The cam action member 146 may include a plunger side cam surface 1461, an action member body 1462, a first protrusion 1463, a second protrusion 1464, and a first guided protrusion 149.

At least a part of the action member body 1462 may be disposed inside the housing body 1422, and at least a part of the remaining area of the action member body 1462 may be exposed to the outside of the housing body 1422.

The action member body 1462 may be configured to be movable in the housing body 1422 in the first direction.

A space for receiving the elastic member 144 may be formed inside the action member body 1462, and the opposite end of the elastic member 144 may be fixed to the action member body 1462 in the space.

The cam action member 146 may be pressed by the elastic member 144 in the first direction, thereby remaining in contact with the head side cam surface 1142. Thereby, the cam action member 146 may provide recovery force to the connecting head 110.

The first protrusion 1463 and the second protrusion 1464 may protrude from one side of the action member body 1462.

A first cam surface 1461A may be formed at one end of the first protrusion 1463, and a second cam surface 1461B may be formed at one end of the second protrusion 1464. The plunger side cam surface 1461 may include the first cam surface 1461A and the second cam surface 1461B.

In this case, when the connecting head 110 is in the rest position, the head side cam surface 1142 may contact both the first cam surface 1461A and the second cam surface 1461B.

On the other hand, when the connecting head 110 is deviated from the rest position, the head side cam surface 1142 may contact one of the first cam surface 1461A or the second cam surface 1461B, and may not contact the other one.

While it is illustrated in FIGS. 7A and 7B that the cam action member 146 includes the first protrusion 1463 and the second protrusion 1464, and the plunger side cam surfaces 1461A and 1461B are formed on the protrusions 1463 and 1464, respectively, the present disclosure is not limited thereto.

For example, the cam action member 146 may not include either the first protrusion 1463 or the second protrusion 1464. In this case, the first cam surface 1461A and the second cam surface 1461B may be formed at both corners of the cam action member 146 facing the head side cam surface 1142, respectively.

Figure 8A:
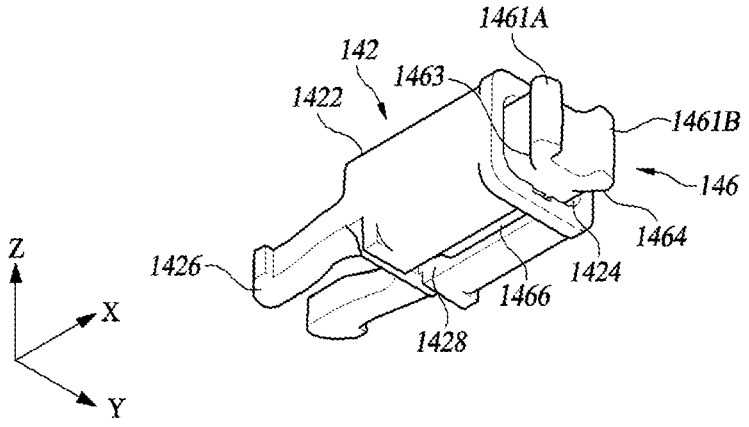
FIGS. 8A and 8B are rear perspective views of the plunger according to an embodiment of the present disclosure.
Figure 8B:
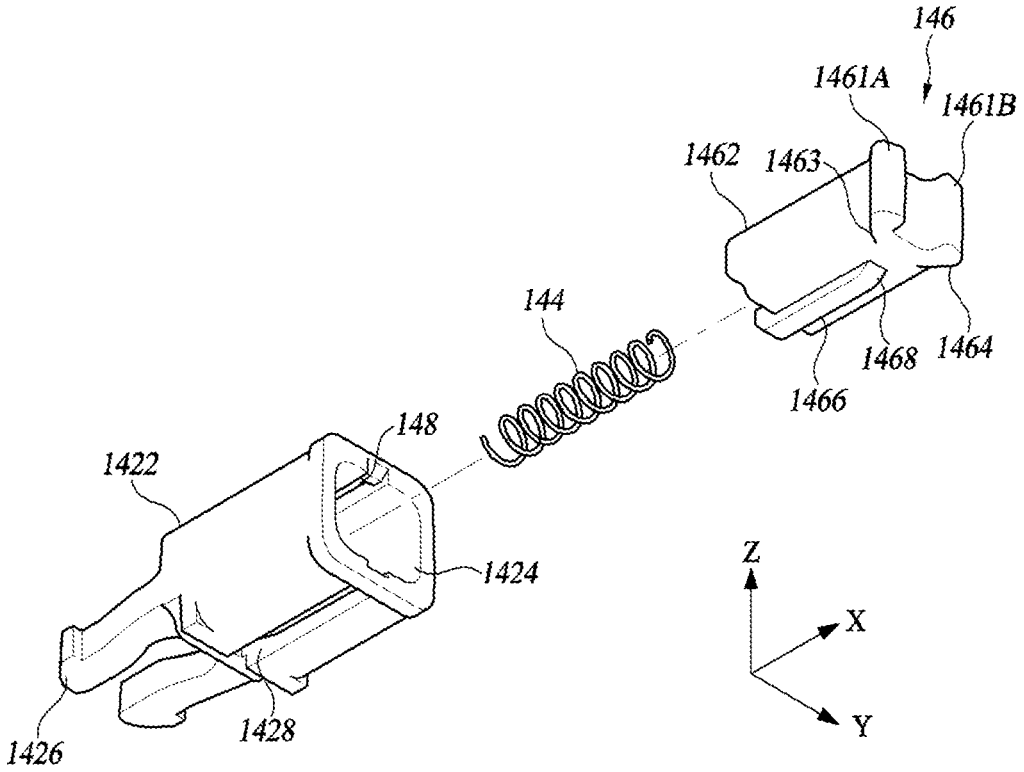

FIGS. 8A and 8B are rear perspective views of the plunger 140 according to an embodiment of the present disclosure.

Specifically, FIG. 8A shows the plunger 140 in an assembled state, and FIG. 8B shows the plunger 140 in a disassembled state.

Referring to FIGS. 8A and 8B, the plunger housing 142 may include a second guiding rail 1428, and the cam action member 146 may include a second guided protrusion 1466.

The second guiding rail 1428 may be formed on the opposite surface of the housing body 1422, and may guide the second guided protrusion 1466.

The second guiding rail 1428 may be disposed on the housing body 1422 to face the first guiding rail 148. However, the present disclosure is not limited thereto.

Figure 9A:
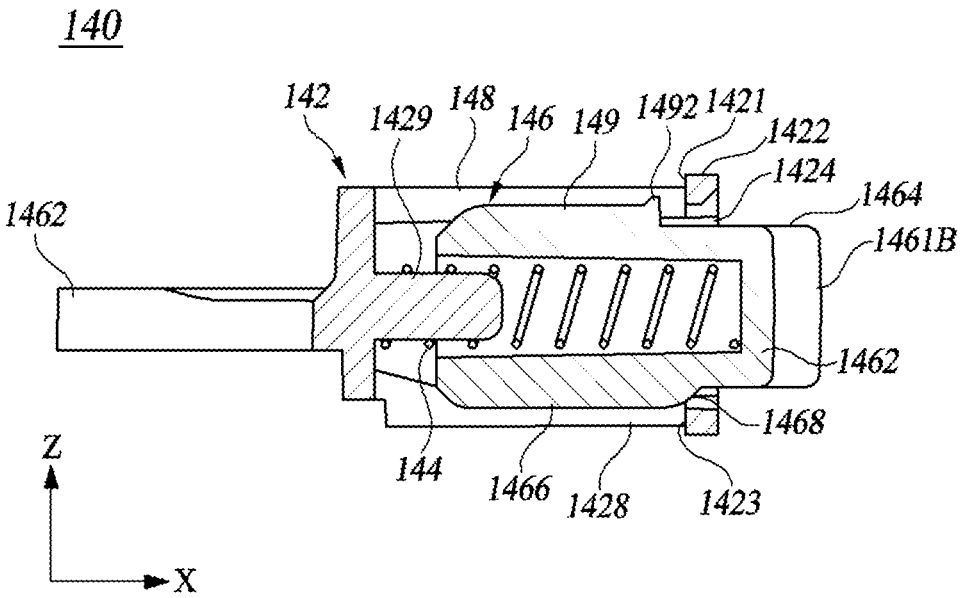
FIGS. 9A and 9B are longitudinal sectional views of the plunger according to the embodiment of the present disclosure, taken along line IX-IX' in FIG. 7A.
Figure 9B:
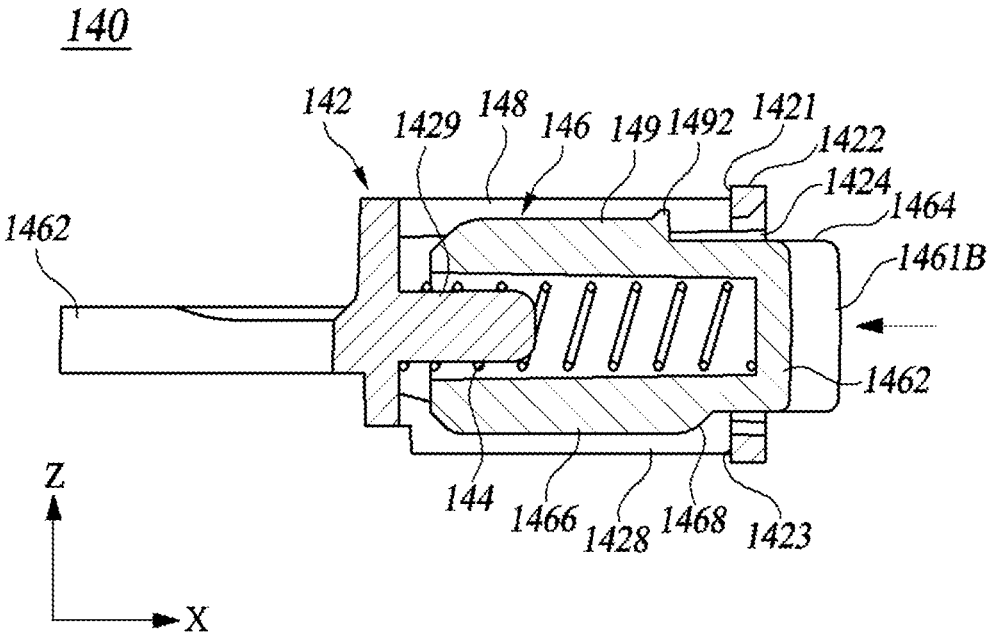

FIGS. 9A and 9B are longitudinal sectional views of the plunger 140 according to an embodiment of the present disclosure, taken along line IX-IX' in FIG. 7A.

Specifically, FIG. 9A shows the plunger 140 with the connecting head 110 placed in the rest position, and FIG. 9B shows the plunger 140 with the connecting head 110 deviated from the rest position.

Referring to FIGS. 9A and 9B, the first guiding rail 148 and the second guiding rail 1428 may be formed on the housing body 1422 in the first direction.

Accordingly, the first guided protrusion 149 and the second guided protrusion 1466 may be guided in the first direction along the first guiding rail 148 and the second guiding rail 1428.

The first guided protrusion 149 may include a guide stopper 1492 at one end thereof facing forward of the plunger 140, and the second guided protrusion 1466 may include an upward cam surface 1468 at one end thereof facing forward of the plunger 140.

In this specification, the forward direction of the plunger 140 refers to a direction in which the plunger 140 faces the connecting head 110. For example, in FIGS. 9A and 9B, the forward direction of the plunger 140 is the direction in which the positive X-axis extends.

The upward cam surface 1468 may be located in front of the guide stopper 1492 on the housing body 1422.

The first guiding rail 148 and the second guiding rail 1428 may include a first jaw 1421 and a second jaw 1423 at ends thereof facing forward of the plunger 140.

The guide stopper 1492 may be configured to contact the first jaw 1421, thereby preventing elastic deformation of the elastic member 144 from causing movement of the cam action member 146 in the first direction.

The upward cam surface 1468 may have a slope extending from the lower side of the plunger 140 toward the upper side of the plunger 140.

Since the upward cam surface 1468 is disposed in front of the guide stopper 1492, the upward cam surface 1468 may contact the second jaw 1423 before the guide stopper 1492 contacts the first jaw 1421.

As the upward cam surface 1468 and the second jaw 1423 contact each other, a cam action may occur between the two members.

At this time, the cam action member 146 may be subjected to force acting upward of the plunger 140 by the slope of the upward cam surface 1468.

Thereby, even when the cam action member 146 moves to the rear of the plunger 140 slightly downward of the plunger 140, the cam action member 146 may be aligned back to a certain position by the upward cam surface 1468 in the rest position.

Referring to FIG. 9A, when the connecting head 110 is in the rest position, the elastic member 144 may have already been elastically deformed and may thus be pressing the cam action member 146 in the first direction.

When the connecting head 110 is in the rest position, the first cam surface 1461A and the second cam surface 1461B are both in contact with the head side cam surface 1142, and accordingly the first cam surface 1461A and the second cam surface 1461B may each press the head side cam surface 1142 by the elastically deformed elastic member 144.

Thereby, the plunger 140 may generate rotational resistance against rotation of the connecting head 110 in the rest position.

The rotational resistance may prevent the location of the razor cartridge 20 from being varied in the rest position, by allowing rotation of the connecting head 110 only when force stronger than the rotational resistance is applied to the connecting head 110.

Referring to FIG. 9B, when the connecting head 110 is deviated from the rest position, the elastic member 144 may be compressed more than when the connecting head 110 is in the rest position.

Accordingly, the plunger 140 may provide stronger recovery force to the connecting head 110 when the connecting head 110 is deviated from the rest position.

Figure 10:
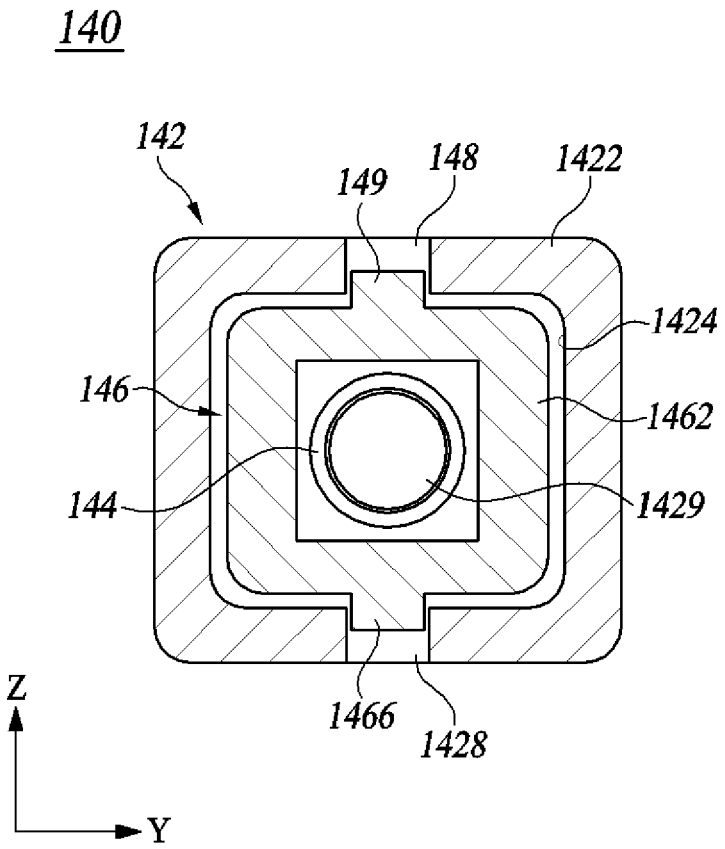
FIG. 10 is a cross-sectional view of the plunger according to the embodiment of the present disclosure, taken along line X-X' in FIG. 7A.

FIG. 10 is a cross-sectional view of the plunger 140 according to an embodiment of the present disclosure, taken along line X-X' in FIG. 7A.

Referring to FIG. 10, the guided protrusions 149 and 1466 may be blocked from moving in a second direction perpendicular to the first direction by contacting one surface of the guiding rail 148, 1428 facing in the second direction.

Thereby, the cam action member 146 may be prevented from being shaken left and right in the second direction during the cam action.

In the present specification, the second direction refers to a direction perpendicular to the first direction and the rotational axis ax2. For example, in FIGS. 8A and 8B, the second direction is the Y-axis direction.

While it is illustrated in FIGS. 9A, 9B, and 10, the guided protrusion 149 and 1466 are formed on the cam action member 146, and the guiding rails 148 and 1428 are formed on the plunger housing 142, the present disclosure is not limited thereto.

For example, the guided protrusions formed on the plunger housing 142 may be configured to be movable in the first direction along the guiding rails formed on the cam action member 146.

Figure 11:
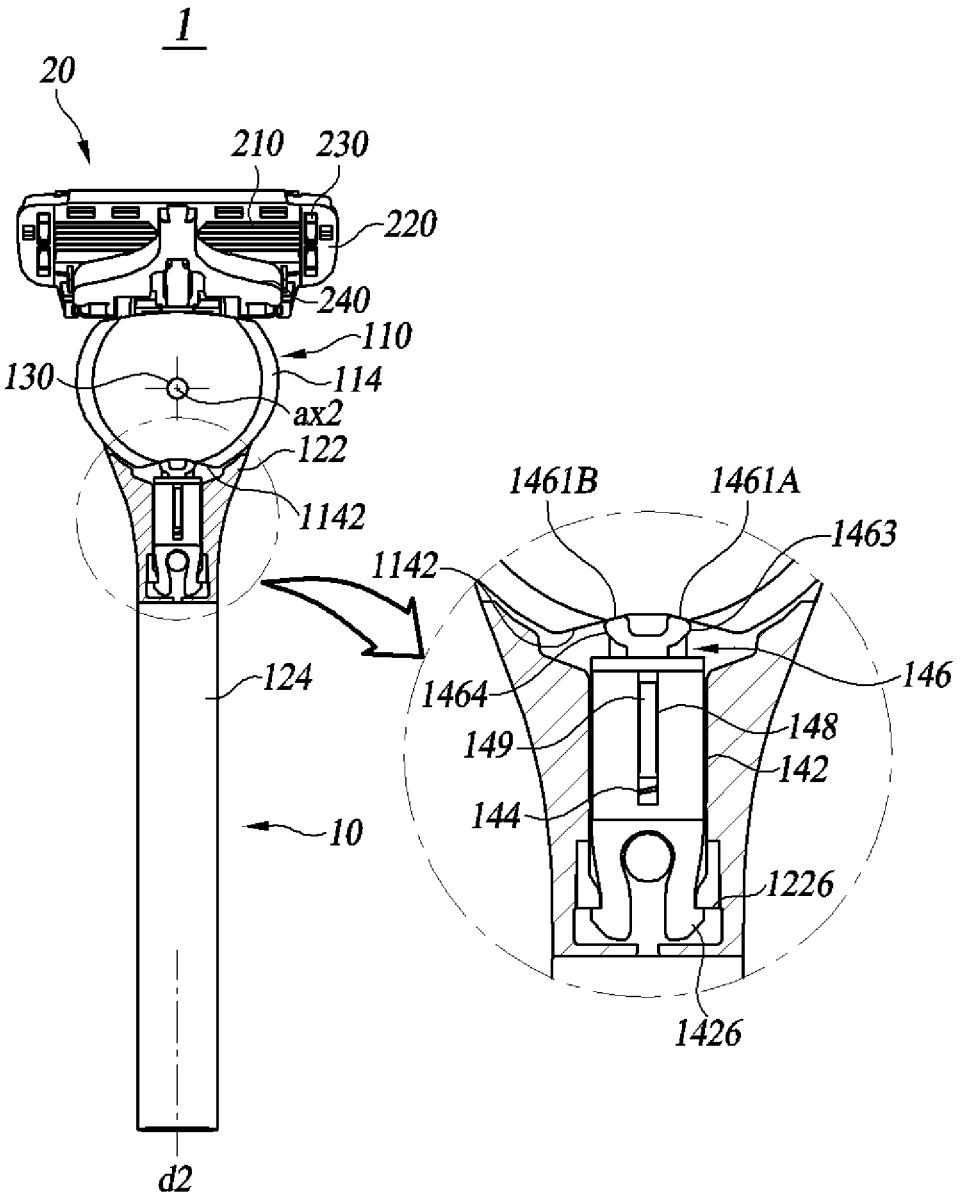
FIG. 11 is a sectional view showing the shape of the razor assembly when a connecting head according to an embodiment of the present disclosure is in a rest position.

FIG. 11 is a sectional view showing the shape of the razor assembly 1 when the connecting head 110 according to an embodiment of the present disclosure is in the rest position.

Referring to FIG. 11, when the connecting head 110 is in the rest position, both the first cam surface 1461A and the second cam surface 1461B may contact the head side cam surface 1142.

In the rest position, the elastic member 144 is already elastically deformed, and accordingly the first cam surface 1461A and the second cam surface 1461B may press the head side cam surface 1142. Thereby, rotational resistance may occur in the connecting head 110.

Specifically, the first cam surface 1461A may generate a clockwise moment around the rotational axis ax2 with respect to the connecting head 110. On the other hand, the second cam surface 1461B may generate a counterclockwise moment around the rotational axis ax2 with respect to the connecting head 110.

In this case, the magnitude of the moment generated by the first cam surface 1461A may be equal to the magnitude of the moment generated by the second cam surface 1461B.

Accordingly, the connecting head 110 may be prevented from rotating in the rest position, and thus, the position thereof may be fixed.

The rotational resistance may be designed to have a magnitude suitable for actual use by adjusting the distance between the connecting head 110 and the plunger 140 or changing the type of the elastic member 144.

For example, in the rest position, the elastic member may be compressed by 0.01 mm to 1.0 mm, and preferably, by 0.03 mm to 0.7 mm.

In this case, the rotational resistance may be from 0.01 kgf to 0.12 kgf, and preferably, from 0.02 kgf to 0.08 kgf. However, the present disclosure is not limited thereto.

Figure 12:
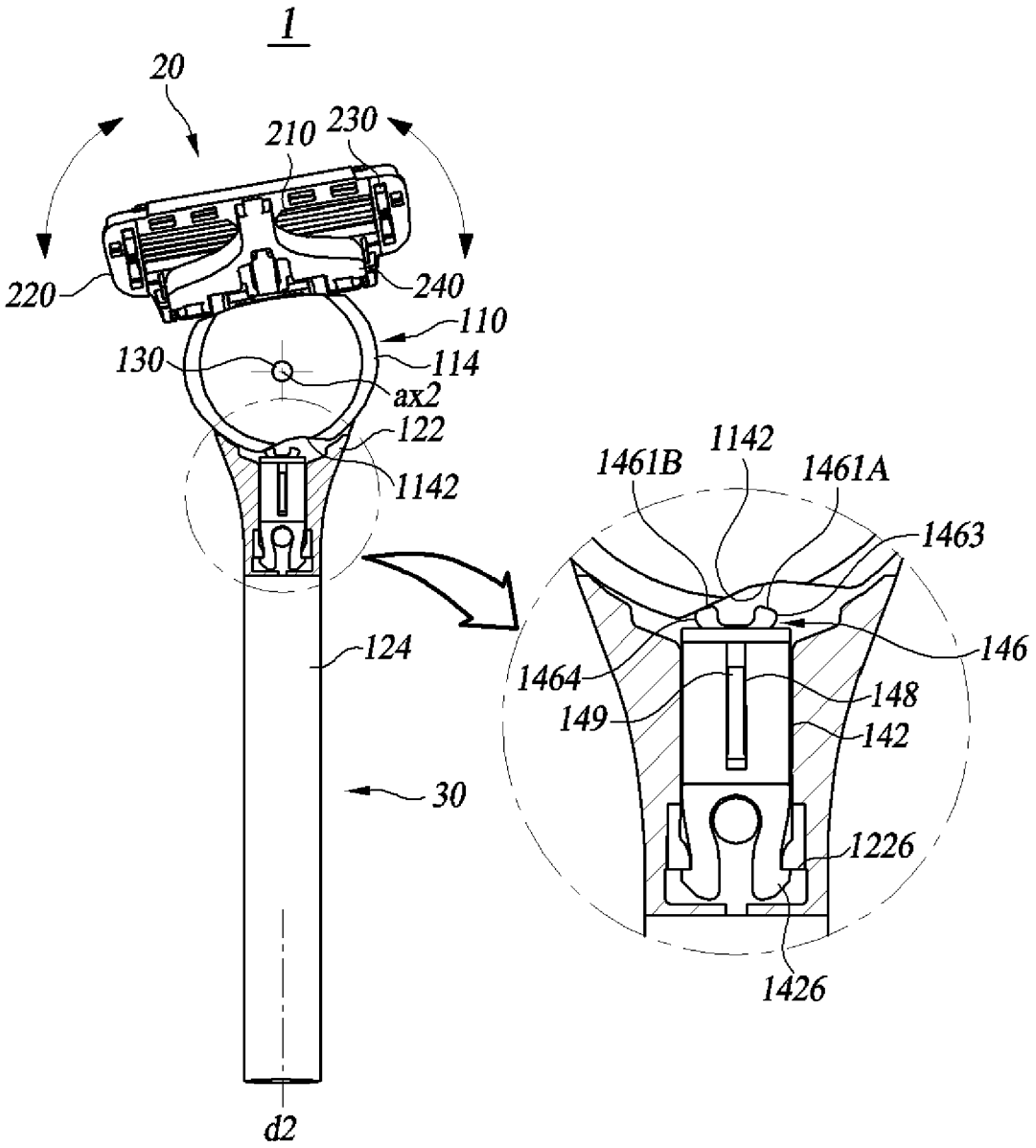
FIG. 12 is a sectional view showing the shape of the razor assembly when the connecting head according to the embodiment of the present disclosure is deviated from the rest position.

FIG. 12 is a sectional view showing the shape of the razor assembly 1 when the connecting head 110 according to an embodiment of the present disclosure is deviated from the rest position.

Referring to FIG. 12, when the connecting head 110 is deviated from the rest position, one of the first cam surface 1461A and the second cam surface 1461B may contact the head side cam surface 1142, and the other one may not contact the head side cam surface 1142.

For example, when the connecting head 110 pivots counterclockwise around the rotational axis ax2, the second cam surface 1461B may contact the head side cam surface 1142 and the first cam surface 1461A may not contact the head side cam surface 1142.

On the other hand, when the connecting head 110 pivots clockwise around the rotational axis ax2, the first cam surface 1461A may contact the head side cam surface 1142 and the second cam surface 1461B may not contact the head side cam surface 1142.

When deviated from the rest position, one of the first cam surface 1461A and the second cam surface 1461B may remain in contact with the head side cam surface 1142, and the plunger 140 may provide the recovery force of the elastic member 144 to the connecting head 110.

Specifically, as only one of the first cam surface 1461A and the second cam surface 1461B contacts the head side cam surface 1142, the plunger 140 may intensively apply a moment to the connecting head 110 in one rotational direction.

For example, when the razor cartridge 20 pivots counterclockwise, the second cam surface 1461B may exert a clockwise moment on the connecting head 110. In this case, the first cam surface 1461A does not contact the head side cam surface 1142, and accordingly no moment acts on the connecting head 110.

In other words, the plunger 140 according to an embodiment of the present disclosure may provide recovery force to the connecting head 110 more effectively by applying the moment intensively to the connecting head 110 in only one rotational direction.

When deviated from the rest position, the elastic member 144 may be more elastically deformed than when in the rest position.

In addition, as the connecting head 110 is deviated farther from the rest position, the elastic member 144 may be compressed more, and accordingly the elastic member 144 may press the cam action member 146 more strongly.

Accordingly, as the connecting head 110 is deviated farther from the rest position, the magnitude of the recovery force may increase.

The contact area of the head side cam surface 1142 and the plunger side cam surface 1461 when the connecting head 110 is deviated from the rest position may be smaller than when the connecting head 110 is in the rest position.

Further, when the connecting head 110 is in the rest position, the head side cam surface 1142 and the plunger side cam surface 1461 may contact each other at two or more points. On the other hand, when the connecting head 110 is deviated from the rest position, the head side cam face 1142 and the plunger side cam face 1461 may contact each other at one point.

When the connecting head 110 is in the rest position, the razor assembly 1 according to an embodiment of the present disclosure may appropriately generate rotational resistance by increasing the contact area and the number of contact points between the head side cam surface 1142 and the plunger side cam surface 1461. Thereby, stable shaving may be provided to the user during shaving.

Specifically, the rotational resistance may prevent the razor cartridge 20 from dangling with respect to the razor handle 10, by fixing the position of the razor cartridge 20 in the rest position.

In addition, when the connecting head 110 is deviated from the rest position, the razor assembly 1 according to an embodiment of the present disclosure may reduce the contact area and the number of contact points between the head side cam surface 1142 and the plunger side cam surface 1461, thereby intensively providing recovery force to a specific point of the connecting head 110 by the plunger 140. Accordingly, during shaving, an appropriate pivoting function may be provided to the user.

Specifically, when the connecting head 110 is deviated from the rest position, the moment acting on the connecting head 110 by the plunger 140 may be intensively applied in one rotational direction. Thereby, the recovery force may be more effectively provided.

Referring back to FIGS. 11 and 12, the head side cam surface 1142 may have a depressed shape on the connecting head 110.

When the same degree of pivoting of the connecting head 110 is given, the depressed shape of the head side cam surface 1142 may more elastically deform the elastic member 144 of the plunger 140 than a convex shape or a flat shape.

Accordingly, even when an elastic member 144 having a smaller spring constant is used, sufficient recovery force may be provided to the connecting head 110.

However, the present disclosure is not limited thereto, and the head side cam surface 1142 may have a convex shape or a flat shape.

The head side cam surface 1142 may be configured in at least two planes.

For example, when the head side cam surface 1142 includes two planes, the two planes may be symmetrically arranged.

In this case, the two planes constituting the head side cam surface 1142 may be configured to contact the first cam surface 1461A and the second cam surface 1461B, respectively.

The first cam surface 1461A and the second cam surface 1461B may have a shape of a curved surface corresponding to each plane. Accordingly, regardless of the degree of pivoting of the connecting head 110, the surfaces may substantially make a line contact or a surface contact with the head side cam surface 1142.

As a result, the plunger 140 according to an embodiment of the present disclosure may perform a cam action more smoothly than when a point contact is made between the plunger side cam surface 1461 and the head side cam surface 1142. Accordingly, when the cam action is performed, the wear generated on the plunger side cam surface may be minimized.

While it is illustrated in FIGS. 11 and 12 that the head side cam surface 1142 is a flat surface and the plunger side cam surface 1461 is a curved surface, the present disclosure is not limited thereto.

For example, the head side cam surface 1142 may be a curved surface, and the plunger side cam surface 1461 may be a flat surface.

In this case, on the head side cam surface 1142 of the depressed shape, the area where the first cam surface 1461A and the second cam surface 1461B contact each other may have a shape of a slightly raised arc.

Thereby, the first cam surface 1461A and the second cam surface 1461B may be configured to substantially make a line contact or a surface contact with the head side cam surface 1142, regardless of the degree of pivoting of the connecting head 110.

Another embodiment of the present disclosure shown in FIGS. 13A and 13B, which will be described later, is different from the embodiment of the present disclosure shown in FIGS. 1 to 12 in that the head side cam surface is configured in one plane. Hereinafter, the distinctive features according to another embodiment of the present disclosure will be mainly described, and redundant descriptions of the components substantially the same as those of the previous embodiment of the present disclosure will be omitted.

Figure 13A:
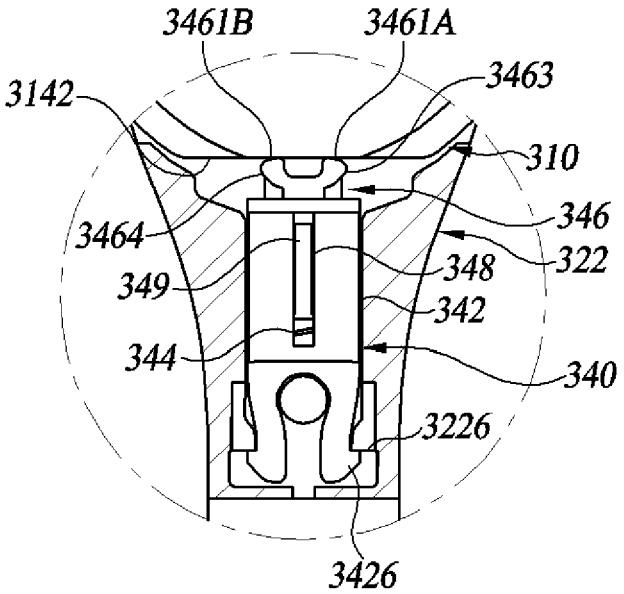
FIGS. 13A and 13B show pivoting of a connecting head around a head adapter according to another embodiment of the present disclosure.
Figure 13B:
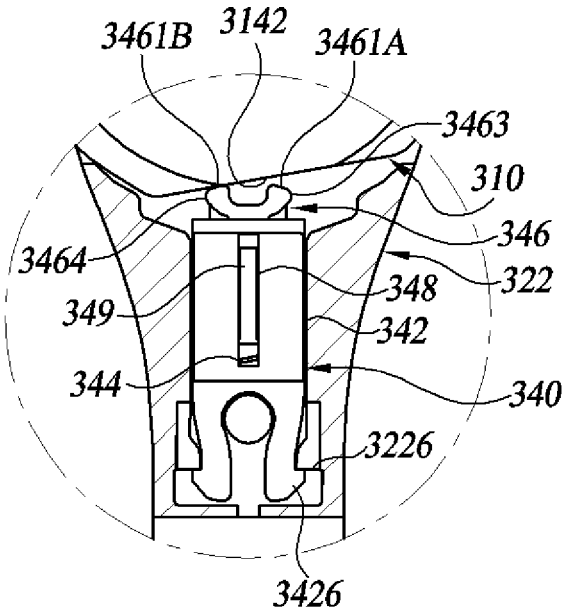

FIGS. 13A and 13B show pivoting of a connecting head 310 around a head adapter 322 according to another embodiment of the present disclosure.

Specifically, FIG. 13A shows a state when the connecting head 310 is in the rest position, and FIG. 13B shows a state when the connecting head 310 is deviated from the rest position.

Referring to FIG. 13A, the head side cam surface 3142 of the connecting head 310 may have one plane.

When the connecting head 310 is in the rest position, both the first cam surface 3461A and the second cam surface 3461B may contact the head side cam surface 3142.

In this case, the areas on the head side cam surface 3142 in contact with the first cam surface 3461A and the second cam surface 3461B may be symmetric to each other.

In the rest position, the elastic member 344 is already elastically deformed, and accordingly the first cam surface 3461A and the second cam surface 3461B may press the head side cam surface 3142. Thereby, rotational resistance may be generated in the connecting head 310.

When the same degree of pivoting of the connecting head 310 is given, the shape of the head side cam surface 3142 configured in one plane may cause smaller elastic deformation to the elastic member 344 of the plunger 340 than in the case where the surface has a concave shape.

In this case, an elastic member 344 having a larger spring constant may be used to generate appropriate recovery force for the smaller elastic deformation.

Thus, in the rest position, the plunger 340 according to this embodiment may provide stronger rotational resistance to the connecting head 310.

Referring to FIG. 13B, when the connecting head 310 is deviated from the rest position, one of the first cam surface 3461A and the second cam surface 3461B may contact the head side cam surface 3142, and the other one may not contact the head side cam surface 3142.

When the connecting head is deviated from the rest position, one of the first cam surface 3461A and the second cam surface 3461B may remain in contact with the head side cam surface 3142, and the plunger 340 may provide the recovery force of the elastic member 344 of the connecting head 310.

When deviated from the rest position, the elastic member 344 may be more elastically deformed than when in the rest position.

In addition, as the connecting head 310 is deviated farther from the rest position, the elastic member 344 may be compressed more, and accordingly the elastic member 344 may press the cam action member 346 more strongly.

Accordingly, as the connecting head 310 is deviated farther from the rest position, the magnitude of the recovery force may increase.

The contact area of the head side cam surface 3142 and the plunger side cam surface 3461 when the connecting head 310 is deviated from the rest position may be smaller than when the connecting head 310 is in the rest position.

Further, when the connecting head 310 is in the rest position, the head side cam surface 3142 and the plunger side cam surface 3461 may contact each other at two or more points. On the other hand, when the connecting head 310 is deviated from the rest position, the head side cam face 3142 and the plunger side cam face 3461 may contact each other at one point.

The first cam surface 3461A and the second cam surface 3461B may have a shape of a curved surface. Accordingly, regardless of the degree of pivoting of the connecting head 310, the surfaces may substantially make a line contact or a surface contact with the head side cam surface 3142.

Yet another embodiment of the present disclosure shown in FIGS. 14A and 14B, which will be described later, is different from the embodiment of the present disclosure shown in FIGS. 1 to 12 in that the cam action member does not include either the first protrusion or the second protrusion. Hereinafter, the distinctive features according to another embodiment of the present disclosure will be mainly described, and redundant descriptions of the components substantially the same as those of the previous embodiment of the present disclosure will be omitted.

Figure 14A:
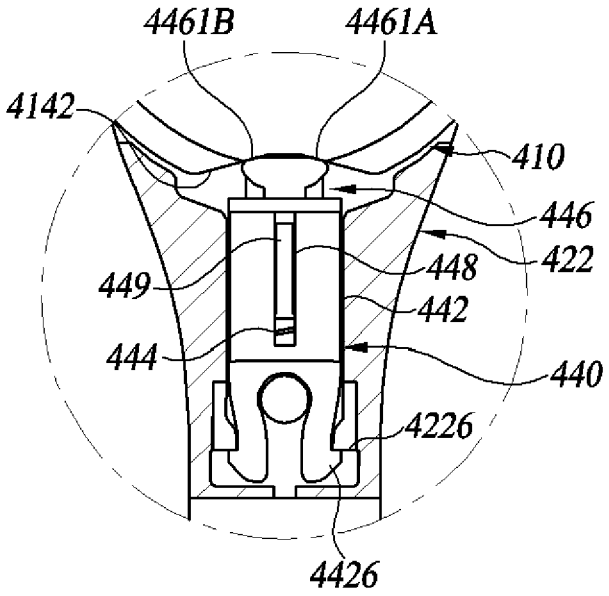
FIGS. 14A and 14B show pivoting of a connecting head around a head adapter according to yet another embodiment of the present disclosure.
Figure 14B:
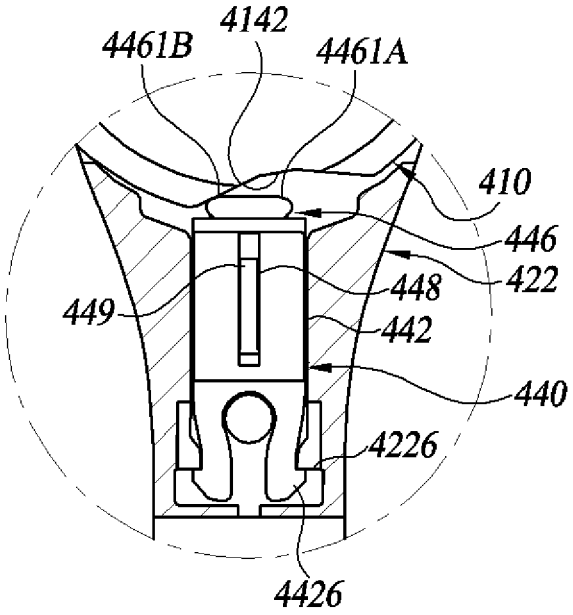

FIGS. 14A and 14B show pivoting of a connecting head 410 around a head adapter 422 according to yet another embodiment of the present disclosure.

Specifically, FIG. 14A shows a state when the connecting head 410 is in the rest position, and FIG. 14B shows a state when the connecting head 410 is deviated from the rest position.

Referring to FIG. 14A, the cam action member 446 may not include any of the first protrusion and the second protrusion according to another embodiment of the present disclosure.

Accordingly, the plunger side cam surface 4461 of the cam action member 446 may have an even surface.

In this case, a first cam surface 4461A and a second cam surface 4461B may be formed at both corners of the cam action member 446 facing the head side cam surface 4142, respectively.

In the razor assembly according to this embodiment, the shape of the cam action member 446 may be simplified by configuring the plunger side cam surface 4461 to have an even surface.

Accordingly, the shape of the plunger side cam surface 4461 may be realized through a simpler manufacturing process.

In addition, when the cam action occurs between the head side cam surface 4142 and the plunger side cam surface 4461, the razor assembly according to this embodiment may distribute the load applied to the first cam surface 4461A and the second cam surface 4461B to a larger area.

Thereby, durability of the cam action member 446 may be improved.

When the connecting head 410 is in the rest position, both the first cam surface 4461A and the second cam surface 4461B may contact the head side cam surface 4142.

In this case, the areas on the head side cam surface 4142 in contact with the first cam surface 4461A and the second cam surface 4461B may be symmetric to each other In the rest position, the elastic member 444 is already elastically deformed, and accordingly the first cam surface 4461A and the second cam surface 4461B may press the head side cam surface 4142. Thereby, rotational resistance may be generated in the connecting head 410.

Referring to FIG. 14B, when the connecting head 410 is deviated from the rest position, one of the first cam surface 4461A and the second cam surface 4461B may contact the head side cam surface 4142, and the other one of the first cam surface 4461A and the second cam surface 4461B may not contact the head side cam surface 4142.

When the connecting head is deviated from the rest position, one of the first cam surface 4461A and the second cam surface 4461B may remain in contact with the head side cam surface 4142, and the plunger 440 may provide the recovery force of the elastic member 444 to the connecting head 410.

When deviated from the rest position, the elastic member 444 may be more elastically deformed than when in the rest position.

In addition, as the connecting head 410 is deviated farther from the rest position, the elastic member 444 may be compressed more, and accordingly, the elastic member 444 may press the cam action member 446 more strongly.

Accordingly, as the connecting head 410 is deviated farther from the rest position, the magnitude of the recovery force may increase.

The contact area of the head side cam surface 4142 and the plunger side cam surface 4461 when the connecting head 410 is deviated from the rest position may be smaller than when the connecting head 410 is in the rest position.

Further, when the connecting head 410 is in the rest position, the head side cam surface 4142 and the plunger side cam surface 4461 may contact each other at two or more points. On the other hand, when the connecting head 410 is deviated from the rest position, the head side cam face 4142 and the plunger side cam face 4461 may contact each other at one point.

The head side cam surface 4142 may be configured in at least two planes.

For example, when the head side cam surface 4142 includes two planes, the two planes may be symmetrically arranged.

In this case, the two planes constituting the head side cam surface 4142 may be configured to contact the first cam surface 4461A and the second cam surface 4461B, respectively.

The first cam surface 4461A and the second cam surface 4461B may have a shape of a curved surface corresponding to each plane. Accordingly, regardless of the degree of pivoting of the connecting head 410, the surfaces may substantially make a line contact or a surface contact with the head side cam surface 4142.

While it is illustrated in the embodiments of FIGS. 1 to 14B that the plunger is disposed on the razor handle, and provides recovery force to the connecting head by performing a cam action on the head side cam surface formed on the connecting head, the present disclosure is not limited thereto.

For example, the plunger may be disposed on the connecting head so as to be pivotable together with the connecting head, and the cam surface that performs a cam action with the plunger may be fixedly formed on the razor handle.

As is apparent from the above description, according to the embodiments, a razor handle and a razor assembly may provide a more effective and appropriate vertical pivoting function by varying a contact area between the cam surfaces depending on whether the razor handle and the razor assembly are in the rest position.

Although exemplary embodiments have been described for illustrative purposes, those skilled in the art to which the present disclosure belongs will appreciate that various modifications and variations can be made without departing from the essential features of the present disclosure. Therefore, the present disclosure is to be construed as illustrative rather than limiting, and the scope of the present disclosure is not limited by the embodiments. The scope of protection of the disclosure should be construed according to the appended claims, and all technical ideas within the scope of the claims and equivalents thereof should be construed as being within the scope of the disclosure.

What is claimed is:

1. A razor handle comprising:

a handle body comprising a head adapter and a grip portion extending from the head adapter;

a connecting head configured to be coupled to a razor cartridge and coupled to the head adapter so as to be pivotable around a rotational axis, the connecting head comprising a head side cam surface on one side thereof; and a plunger disposed on one side of the handle body and comprising a plunger side cam surface configured to perform a cam action with the head side cam surface, the plunger being configured to provide, through the cam action, recovery force to restore the connecting head to a rest position, wherein:

a contact area between the head side cam surface and the plunger side cam surface is smaller when the connecting head is deviated from the rest position than when the connecting head is in the rest position;

the plunger further comprises a plunger housing, an elastic member disposed inside the plunger housing, and a cam action member having at least a part disposed inside the plunger housing and having the plunger side cam surface formed on one side thereof;

the elastic member is elastically deformed to press the cam action member in a first direction; and the cam action member is pressed in the first direction by the elastic member to provide the recovery force to the connecting head.

2. The razor handle of claim 1, wherein:

when the connecting head is in the rest position, the head side cam surface and the plunger side cam surface contact each other at two or more points; and when the connecting head is deviated from the rest position, the head side cam surface and the plunger side cam surface contact each other at only one point.

3. The razor handle of claim 1, wherein, as the connecting head is deviated farther from the rest position, a magnitude of the recovery force increases.

4. The razor handle of claim 1, wherein:

the cam action member comprises a first protrusion and a second protrusion projecting from one side of the cam action member;

the plunger side cam surface comprises a first cam surface formed at one end of the first protrusion and a second cam surface formed at one end of the second protrusion;

when the connecting head is in the rest position, the head side cam surface contacts both the first cam surface and the second cam surface; and when the connecting head is deviated from the rest position, the head side cam surface is in contact with only one of the first cam surface and the second cam surface.

5. The razor handle of claim 4, wherein, when the connecting head is in the rest position, a magnitude of moment generated in the connecting head by the first cam surface is equal to a magnitude of moment generated in the connecting head by the second cam surface.

6. The razor handle of claim 1, wherein the plunger further comprises:

a guiding rail formed on one of the plunger housing or the cam action member in the first direction; and a guided protrusion formed on the other of the plunger housing or the cam action member, the guided protrusion being guided by the guiding rail and movable in the first direction, wherein the guided protrusion contacts one surface of the guiding rail facing in a second direction perpendicular to the first direction, such that movement of the guided protrusion in the second direction is prevented.

7. The razor handle of claim 1, wherein the plunger housing is coupled to the handle body.

8. The razor handle of claim 1, wherein the plunger housing is integrated with the handle body.

9. The razor handle of claim 1, wherein the head side cam surface has a depressed shape on the connecting head.

10. The razor handle of claim 9, wherein the head side cam surface includes at least two planes.

11. A razor assembly comprising:

a razor handle comprising:

a handle body comprising a head adapter and a grip portion extending from the head adapter;

a connecting head configured to be coupled to a razor cartridge and coupled to the head adapter so as to be pivotable around a rotational axis penetrating the head adapter, the connecting head comprising a head side cam surface on one side thereof; and a plunger disposed on one side of the handle body and comprising a plunger side cam surface configured to perform a cam action with the head side cam surface, the plunger being configured to provide, through the cam action, recovery force to restore the connecting head to a rest position, wherein:

a contact area between the head side cam surface and the plunger side cam surface is smaller when the connecting head is deviated from the rest position than when the connecting head is in the rest position;

the plunger further comprises a plunger housing, an elastic member disposed inside the plunger housing, and a cam action member having at least a part disposed inside the plunger housing and having the plunger side cam surface formed on one side thereof;

the elastic member is elastically deformed to press the cam action member in a first direction; and the cam action member is pressed in the first direction by the elastic member to provide the recovery force to the connecting head; and the razor cartridge coupled to the connecting head and comprising:

at least one shaving blade having a cutting edge; and a blade housing configured to receive the at least one shaving blade in a transverse direction that is perpendicular to the rotational axis.

12. The razor assembly of claim 11, wherein the razor cartridge is coupled to the connecting head so as to be pivotable around a pivot axis that is parallel to the transverse direction.

* * * * *